United States Patent [19]

Mader

[11] 4,132,054

[45] Jan. 2, 1979

[54] HACKAMORE BRIDLE

[76] Inventor: Oscar J. Mader, Box 598, Buffalo, Wyo. 82834

[21] Appl. No.: 682,441

[22] Filed: May 3, 1976

[51] Int. Cl.[2] ..... B68B 1/04

[52] U.S. Cl. ..... 54/6 R

[58] Field of Search ..... 54/6–9, 54/15

[56] References Cited

U.S. PATENT DOCUMENTS

| | | | |
|---|---|---|---|
| 1,478,958 | 12/1923 | Heien | 54/6 R |
| 2,469,046 | 5/1949 | Laws | 54/6 R |
| 2,625,780 | 1/1953 | Flatt | 54/6 R |

FOREIGN PATENT DOCUMENTS

| | | | |
|---|---|---|---|
| 24685 | 6/1906 | Austria | 54/6 R |
| 458930 | 12/1936 | United Kingdom | 54/6 R |

*Primary Examiner*—Louis G. Mancene
*Assistant Examiner*—G. Lee Skillington
*Attorney, Agent, or Firm*—David H. Hill

[57] ABSTRACT

A hackamore bridle is disclosed that may be positioned on an animal such as a horse, with the bridle exerting pressure substantially only on the nose of the animal when the reins are pulled. The bridle includes a headstall having a pair of cheek plates connected between cheek straps and a chin strap so that the cheek plates are adjacent to the cheeks of the animal when the headstall is positioned on the head of the animal. Reins are connected to one end of a pair of rein levers, the other end of each of which is pivoted on the cheek plates. A nose strap is connected between the levers and freely passes through eyelets on the cheek plates, so that pressure is exerted by the nose strap on the nose of an animal when the headstall is positioned on the animal, with the nose strap being tightened on the nose of the animal by pivoting of the levers without applying appreciable pressure to the jaw of the animal through the chin strap. In addition, the bridle may also include a second chin strap positioned forwardly of the first chin strap when positioned on an animal, and a rod also extends between the ends of the levers where the reins are attached.

6 Claims, 3 Drawing Figures

FIG. 1
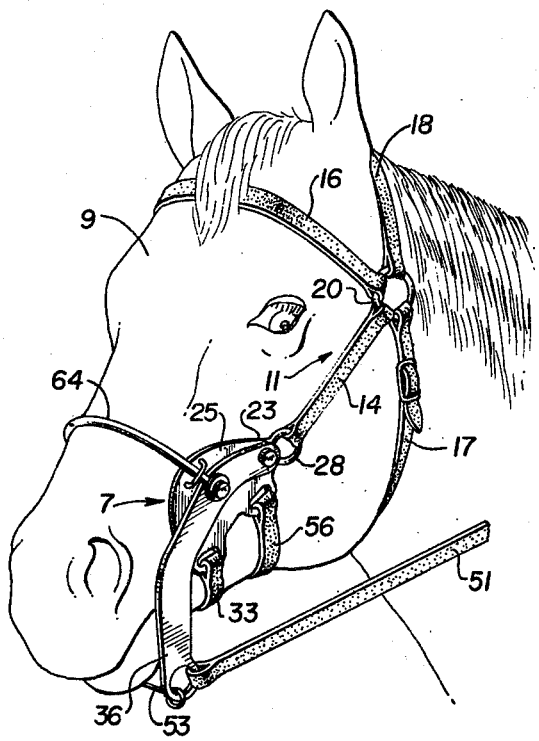
FIG. 2
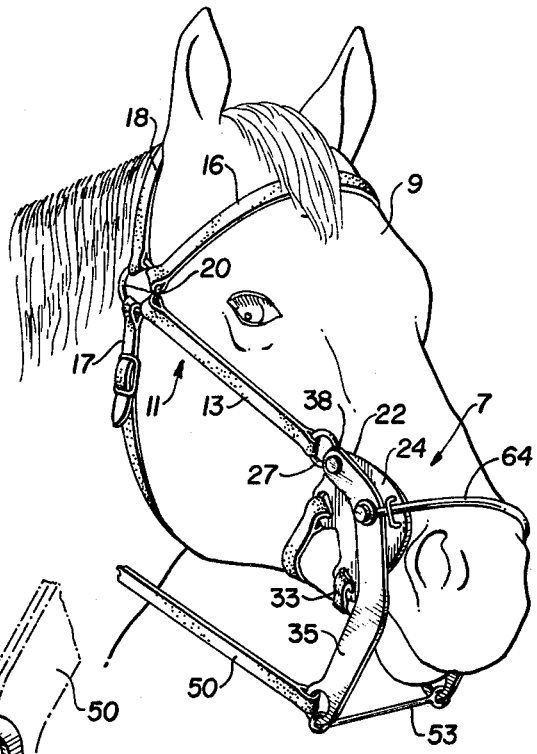
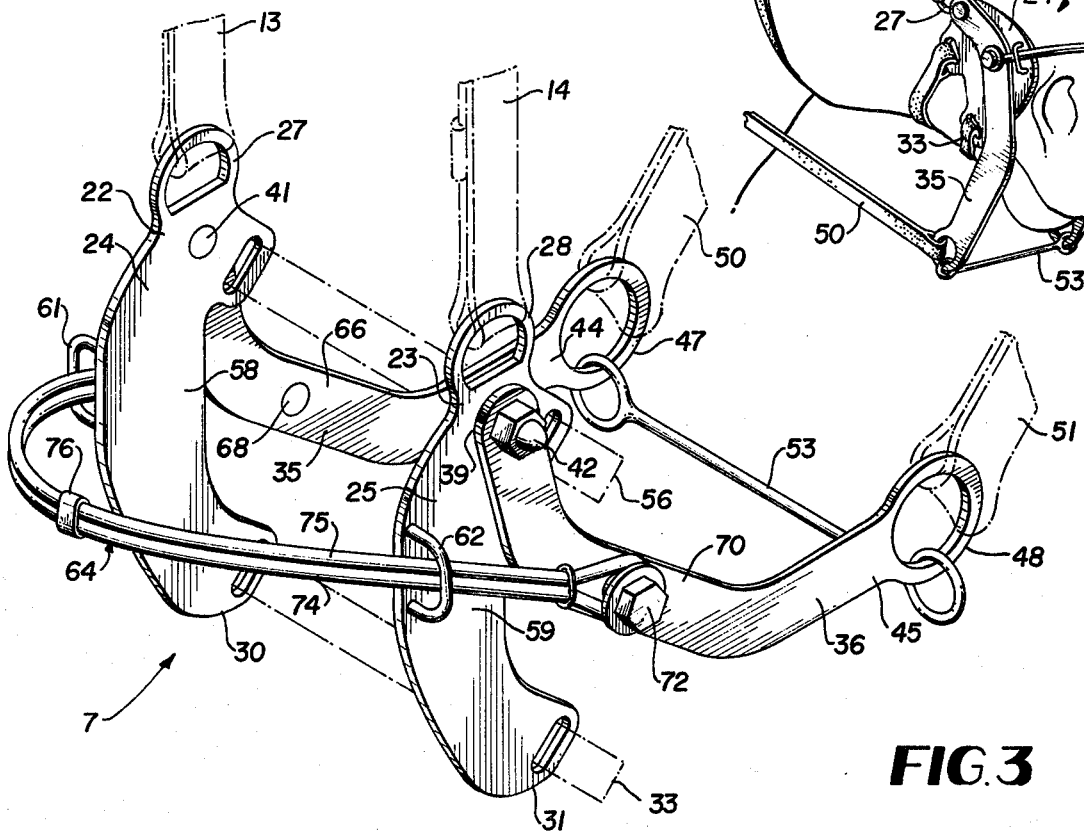
FIG. 3

HACKAMORE BRIDLE

FIELD OF THE INVENTION

This invention relates to a hackamore bridle, and more particularly relates to a hackamore bridle for applying pressure substantially only to the nose of an animal such as a horse.

BACKGROUND OF THE INVENTION

Bridles have heretofore been developed for animals such as horses, and many diverse forms and structures have been developed and suggested over the years. Among the types developed have been bridles that utilize a bit in the mouth of the animal as well as the bitless, or hackamore, type of bridle.

The hackamore bridle customarily does not include a piece or bit that is received in the mouth of the animal, and a rider pulling on the reins of such a bridle has heretofore exerted a pressure commonly on the jaw of the animal to indicate to the horse a desired change, such as a change in direction of movement of the animal, for example. Examples of prior art showing a hackamore bridle that exerts pressure on the jaw of a horse include U.S. Pat. Nos. 3,149,448 and 2,463,279.

While a hackamore bridle has been suggested that applies pressure to the nose of a horse, such bridles have also applied pressure to the jaw of the horse. Examples of prior art showing bridles that apply pressure to the nose and jaw of a horse include U.S. Pat. Nos. 3,458,971; 2,623,340; 2,413,426; 2,347,752; 2,225,232; 1,653,382 and 725,626.

Thus, while hackamore bridles have been developed or suggested that include structure for applying pressure to the nose of an animal when the reins are pulled, such bridles have not proved to be completely successful, at least in providing a hackamore bridle in which nose pressure is applied to an animal without applying appreciable pressure to the jaw of the animal.

SUMMARY OF THE INVENTION

This invention provides an improved hackamore bridle that applies pressure substantially only to the nose of the horse when the reins are pulled. The bridle includes a headstall with cheek plates connected between cheek straps and a chin strap, rein levers pivoted on the cheek plates, and a nose strap connected to the rein levers and freely passing through eyelets on the cheek plates to apply pressure to the nose of an animal when the rein levers are actuated by pulling the reins connected to the levers.

It is therefore an object of this invention to provide an improved hackamore bridle.

It is another object of this invention to provide an improved hackamore bridle for an animal such as a horse.

It is still another object of this invention to provide an improved hackamore bridle that applies pressure substantially only to the nose of an animal when the reins are pulled.

It is yet another object of this invention to provide an improved hackamore bridle that includes levers pivoted on cheek plates to apply pressure to the nose of an animal through a nose strap.

It is still another object of this invention to provide an improved hackamore bridle that includes a headstall with cheek plates connected between cheek straps and a chin strap, and having levers pivoted on said cheek plates, which levers are connected to a nose strap to exert pressure on the nose of an animal when the levers are pivoted.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein-disclosed invention are meant to be included as coming within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a prespective view of the hackamore bridle of this invention shown typically positioned on the head of a horse;

FIG. 2 is a perspective view of the hackamore bridle shown in FIG. 1, but showing the bridle positioned at a different typical position on the head of a horse; and FIG. 3 is a perspective view of a portion of the hackamore bridle of this invention as shown in FIGS. 1 and 2.

DESCRIPTION OF THE INVENTION

Referring now to the drawings, the numeral 7 refers generally to the hackamore bridle of this invention shown in FIGS. 1 and 2, positioned on the head 9 of a horse.

Hackamore bridle 7 includes, as is conventional, a headstall 11 for positioning the bridle on the head of a horse. Headstall 11 includes a pair of cheek straps 13 and 14 that connect to a brow band 16, a throat latch 17, and a crown piece 18, the connection being made by rosettes 20. This portion of headstall 11 is conventional and is shown, for example, in U.S. Pat. No. 3,149,448. In addition, this portion of the headstall can be modified as desired, for example, as shown in U.S. Pat. No. 2,463,279 where the brow band and throat latch are not utilized.

As shown in the drawings, in the headstall of this invention, cheek straps 13 and 14 are connected to the top portions 22 and 23 of cheek plates 24 and 25, respectively, as by the cheek straps being received in rings 27 and 28 at the top portion of the cheek plates. As seen in FIG. 3 of the drawings, the cheek straps 13 and 14 are preferably adjustable in length.

The top portions 22 and 23 of cheek plates 24 and 25, respectively, also have a chin strap 56 connected therebetween, with this strap also preferably being adjustable in length.

A pair of rein levers 35 and 36 have upper ends 38 and 39, respectively, conventionally pivoted, as by means of pivot pins 41 and 42, respectively, on the top portions 22 and 23 of cheek plates 24 and 25, respectively. The lower ends 44 and 45 of rein levers 35 and 36, respectively, have rings 47 and 48 formed thereon for attachment of the ends of reins 50 and 51 thereto. In addition, a rein shank bar or rod 53 extends between rings 47 and 48.

The bottom portions 30 and 31 of cheek plates 24 and 25 may also have a second chin strap 33 extending therebetween. When the headstall is positioned on an animal, the second chin strap 33 is forward of chin strap 56 and is also preferably adjustable in length.

The central portions 58 and 59 of cheek plates 24 and 25, respectively, have eyelets or loops 61 and 62, respectively, thereon, which eyelets extend normally outwardly from the plane of the cheek plates. A nose strap 64 extends through the eyelets 61 and 62, being freely movable with respect thereto. Said eyelets 61 and 62 retain the nose strap 64 in position to keep it from riding on or rubbing the nose of the horse or from dropping and cutting off the breathing ability of the horse when the reins are pulled. One end of nose strap 64 is conventionally mounted on the upper central portion 66 of rein lever 35 by means of bolt 68, while the other end of nose strap 64 is conventionally mounted on the upper central portion 70 of rein lever 36 by means of bolt 72. As shown in FIG. 3, nose strap 64 preferably includes a pair of contiguous cables 74 and 75 having a centrally located spacer 76 thereon.

Thus, as can be seen from the drawings, pulling of reins 50 and 51 causes rein levers 35 and 36 to pivot about pivots 41 and 42, which pulls or retracts nose strap 64. This tightens the nose strap on an animal having the headstall positioned thereon and, due to the particular structure utilized, does not appreciably tighten the chin strap or apply pressure to the jaw of the animal. In this respect, it is to be noted that the chin strap is relatively wide with respect to the nose strap and is of leather to take as much pressure off the jaw of the animal as is possible. Further, a tightening of the reins exerts a downward pull on the headstall 11, tending to hold the horse's head down by downward pressure on the crown piece 18.

In operation, the headstall is adjusted as desired to fit the head of the horse by adjusting the chin strap and cheek straps. The nose strap can be positioned as desired either back on the nose of the horse as indicated in FIG. 1, or near the front of the nose as indicated in FIG. 2. When the reins are then pulled by a rider, the nose strap is retracted, or tightened, about the nose of the horse and a pressure exerted on the nose, without appreciable pressure also being applied to the jaw of the horse through the chin straps.

In a working embodiment of this bridle, it has been found that a horse having the bridle of this invention positioned on his head has a tendency to tuck his head and keep it down where he can see what he is doing, rather than raising his head to get away from pressures applied to his underjaw as has been often found to be the situation when bridles applying pressure to the jaw have been utilized.

In view of the foregoing, it can be seen that this invention provides an improved hackamore bridle that applies pressure substantially only to the nose of an animal having the bridle positioned thereon. Hence, the invention is not to be considered as being limited to the particular details given, nor to the specific application to which reference has been made during the description of the apparatus, except insofar as may be required by the scope of the appended claims.

What is claimed is:

1. A hackamore horse bridle, comprising:

stationary headstall means including a chin strap, a pair of cheek straps each having a forward end, and a pair of cheek plates each having a forward portion, a central portion and a rear portion, the forward end of each of said cheek straps being connected to a respective one of said cheek plates at the rear portion thereof, and the chin strap being connected between the cheek plates at the respective rear portions thereof, so that said headstall means may be fixedly positioned on the head of a horse with said cheek plates adjacent the cheeks of the horse, the forward portions of said cheek plates extending from the central portions thereof in the direction of the horse's nose and mouth, and the rear portions of said cheek plates extending from the central portions thereof in the direction of the horse's neck;

an eyelet mounted on the central portion of each of said cheek plates;

reining means including a pair of reins and a pair of elongate levers, each of said levers having one end thereof pivoted to the rear portion of a respective one of said cheek plates and the other end connected to a respective one of said reins; and nose strap means connected between the central portions of said levers and passing freely through said eyelets, whereby pivoting of said levers causes pressure to be exerted substantially solely on the nose of a horse having said headstall positioned thereon without appreciably causing pressure to be exerted by said chin strap on said horse.

2. A hackamore bridle in accordance with claim 1, wherein said headstall means includes a second chin strap connected between the forward portions of said cheek plates, so that said second chin strap is forward of said first chin strap when said headstall is positioned on an animal.

3. A hackamore bridle in accordance with claim 1, and including a rein shank bar extending between said other ends of said levers.

4. A hackamore bridle in accordance with claim 1, wherein said nose strap means comprises a pair of cables extending between said levers.

5. A hackamore bridle in accordance with claim 1, wherein said chin strap is relatively wide with respect to said nose strap means, so that when pressure is exerted by said nose strap means on the nose of an animal no appreciable pressure is exerted by the chin strap on said animal.

6. A hackamore bridle in accordance with claim 1, wherein said headstall means includes a second chin strap connected between the forward portions of said cheek plates so that said second chin strap is forward of said first chin strap when said headstall means is positioned on a horse, and wherein said reining means includes a rod connected between said other ends of said levers, said rod being positioned below said chin straps when said headstall means is positioned on a horse.

* * * * *